United States Patent [19]

Braun et al.

[11] 4,127,982

[45] Dec. 5, 1978

[54] METHOD OF AND AN APPARATUS FOR MANUFACTURING A SZ TWISTED STRAND OF ELONGATED ELEMENTS FOR TELECOMMUNICATION CABLES

[75] Inventors: Dieter Braun, Bergisch Gladbach; Hugo Cramer, Cologne, both of Fed. Rep. of Germany

[73] Assignee: Felten & Guilleaume Kabelwerke GmbH, Cologne, Fed. Rep. of Germany

[21] Appl. No.: 844,425

[22] Filed: Oct. 21, 1977

[30] Foreign Application Priority Data

Oct. 23, 1976 [DE] Fed. Rep. of Germany ..... 2648140
Oct. 26, 1976 [DE] Fed. Rep. of Germany ..... 2648368

[51] Int. Cl.[2] ..... H01B 13/04; D07B 3/00
[52] U.S. Cl. ..... 57/294; 57/293
[58] Field of Search ..... 57/34 R, 34 AT, 59, 57/60, 156, 160, 91

[56] References Cited

U.S. PATENT DOCUMENTS

| | | | |
|---|---|---|---|
| 3,052,079 | 9/1962 | Henning | 57/34 AT |
| 3,797,217 | 3/1974 | Braun | 57/34 AT |
| 3,884,024 | 5/1975 | Oestreich | 57/34 AT |
| 3,884,025 | 5/1975 | Oberender et al. | 57/34 AT |

*Primary Examiner*—Donald Watkins

*Attorney, Agent, or Firm*—Michael J. Striker

[57] ABSTRACT

A plurality of elongated elements is maintained at a distance from one another by a spacing element, joined together at an inlet nipple, and twisted in the same twisting direction at a constant twisting speed by a twisting head located downstream of the inlet nipple, to emerge from the twisting head through an outlet nipple. The distance of the spacing element from the inlet nipple is cyclically varied by displacing the spacing element at a displacement speed which is lower than the advancement speed of the elements. The displacement speed is increased to the advancement speed during the displacement of the spacing element from a terminal position of a trajectory of displacement of the separating element which is more remote from the twisting head than the other terminal position, in a section of the trajectory having a length which is a predetermined fraction of the length of the trajectory. When a plurality of SZ-twisted strands is to be united into a single braid downstream of the outlet nipples from which the individual strands emerge, the spacing elements associated with the individual strands are all displaced in the same displacement cycles, but the cycles of the respective spacing elements are time-shifted relative to one another so that the transmission from the S-twist to the Z-twist will occur at a different location of the braid for each of the strands.

22 Claims, 2 Drawing Figures

METHOD OF AND AN APPARATUS FOR MANUFACTURING A SZ TWISTED STRAND OF ELONGATED ELEMENTS FOR TELECOMMUNICATION CABLES

BACKGROUND OF THE INVENTION

The present invention relates to the manufacture of SZ-twisted strands or braids of such strands in general, and particularly to the manufacture of such strands or braids for use in telecommunication cables.

There is already known, for instance, from the German Pat. No. 2,138,239, a method of and an apparatus for SZ twisting of individual elongated elements each of which may be constituted by a bunch of non-twisted or twisted filaments, particularly for use in telecommunication cables. It is also already known from this patent to advance the elongated elements longitudinally thereof, after withdrawing the elements from stationary supplies, and to twist the elongated elements by resorting to the use of a twisting head which is arranged between an inlet nipple and an outlet nipple, to thereby obtain a twisted strand of the elements which is subsequently wound on stationary drums, reels or other storage equipment. In this prior-art arrangement, the twisting head is stationary but for its continuous rotation at the same twisting speed and in the same twisting direction, while a spacing element which keeps the individual elongated elements at a distance upstream of the inlet nipple is cyclically displaced in and contrary to the advancement direction of the elongated elements at a displacement speed which is lower than the advancement speed of the elongated elements, thereby cyclically varying the distance of the spacing element from the inlet nipple. On the other hand, the distance between the twisting head and the outlet nipple remains constant.

It is also already known from the above-mentioned patent to unite a plurality of the strands obtained in the above-mentioned manner into a braid. In this connection, it has been proposed in order to electrically decouple the twisted elements of the braid, to vary the displacement speed of the individual spacing elements with respect to one another. These variations in the displacement speeds can be accomplished solely as a function of the location, that is, by individually controlling the displacement speeds of the individual twisting arrangements, or as a function of both the location and the time. In the first instance, the displacement speed is constant for each of the strands which are to be united into the braid, but the displacement speed of each of the spacing elements is different by a certain factor from those of all of the other spacing elements. This results in a situation where the lengths of the same-twist zones of the same strand are the same, but such lengths are different for each of the strands. In the second instance, the displacement speeds of the individual separating elements associated with the respective strands will somewhat vary in time independently of one another.

Experience with the above-discussed arrangement has shown that twist-free regions develop at the transition from a twisted zone of one twisting direction to the twisting zone of the other direction, as a result of the fact that the direction of displacement of the spacing element is reversed at the two terminal positions of the trajectory of displacement of the spacing element. Of course, such twist-free regions are undesirable in the twisted strand or cable. On the other hand, it has also been established by experience that, when it is desired to stagger the transition regions at which the twist of the individual strands takes place in accordance with the prior-art proposals, it is impossible to displace the respective spacing elements from a single driving arrangement, because of the different displacement speeds of the individual spacing elements. Rather, it is necessary to arrange transmissions of a step-up or step-down type between the individual spacing elements, as a result of which undesirably high expenditures are incurred.

SUMMARY OF THE INVENTION

Accordingly, it is a general object of the present invention to avoid the disadvantages of the prior art.

More particularly it is an object of the present invention to develop a method of manufacturing SZ-twisted strands or braids of such strands which is not possessed of the disadvantages of the prior-art methods.

Still another object of the present invention is to shorten the transitory regions between the zones of different twists of the strand, thereby reducing the extent to which the individual elements extend parallel to one another.

Still another object of the present invention is to devise a method of the type here under consideration which renders it possible to stagger the transition regions of the individual strands within the braid with respect to one another, without incurring substantial equipment and operating expenditures.

A concomitant object of the present invention is to design an apparatus which is capable of performing the above-mentioned objects.

Yet another object of the present invention is to so construct the apparatus as to be simple in construction, inexpensive to manufacture and operate, and reliable nevertheless.

In pursuance of these objects and others which will become apparent hereafter, one feature of the present invention resides, briefly stated, in a method of manufacturing SZ-twisted strand of elongated elements for use in cables particularly telecommunication cables, which comprises the steps of advancing the elements at a constant advancement speed along a path; maintaining the elements at a distance from one another at a first location of the path; joining the elements into a bundle at a second location of the path situated downstream of the first location; twisting the bundle into the strand at a constant twisting speed and in the same direction at a third location situated downstream of said second location; and cyclically reciprocating said first location along a portion of the path between two terminal positions, including displacing said first location at a displacement speed lower than said advancement speed and increasing said displacement speed during the displacement of said first location along a section of the path portion commencing at, and in direction away from, at least one of said terminal positions. As a result of the increase in the displacement speed, the difference between the advancement speed $V_o$ and the displacement speed $V_s$ becomes very small for a predetermined period of time so that the twist $$D = (n/v) = n/(v_o - v_s),$$

wherein n is the number of revolutions of the twisting head and v is the relative speed of movement of the twisting zone, becomes very large of the entire duration of the time period during which the displacement speed $v_s$ is increased. As a result of this, a very rapid transition from one of the twisting directions into the other is achieved at the time reversal of the movement of the spacing element, owing to which the length of the transition region having the parallel elements is reduced in the twisted strand or the cable.

In a currently preferred embodiment of the present invention, the increasing step includes raising the displacement speed to the advancement speed so that the relative speed between the advancement speed $v_o$ and the displacement speed $v_s$ is reduced to zero. Advantageously, the increasing step is performed at that terminal position which is more remote from the second location than the other terminal position. In this manner, the time period which is necessary for converting from the relatively small twist during the opening of the twist of the strand into the relatively large twist during the closing of the twist of the strand, is shortened.

According to a further advantageous aspect of the present invention the path section during the displacement in which the speed of the spacing element is increased has a length x related to the length 1 of the path portion in accordance with the formula $$x = 1 \cdot a/(a^{1-a})$$

wherein $a = v_s/v_o$, $v_s$ being the displacement speed and $v_o$ the advancement speed. The above formula is valid for the event that the displacement speed $v_s$ is equal to the advancement $v_o$, and for the same displacement speed $v_s$ of the spacing element both in the forward and the rearward displacement mode. Based on the above-formula, the optimum length of the path section of increased displacement speed can be calculated based on the given advancement speed $v_o$, displacement speed $v_s$, and the length 1 of the path portion in which the separating element reciprocates.

A further concept of the present invention resides in an apparatus for manufacturing a SZ-twisted strand of elongated elements for use in cables, particularly telecommunication cables, which comrpises means for advancing the elements with a constant advancement speed along a path; a spacing element for maintaining the elements at a distance from one another; an inlet nipple for joining the elements into a bundle downstream of said spacing element; a twisting head for twisting the bundle into the strand at a constant twisting speed and in the same direction downstream of said inlet nipple; an outlet nipple downstream of said twisting head; means for mounting said spacing element for displacement along said path in a trajectory toward and away from said twisting head between two terminal positions; and means for cyclically reciprocating said spacing element in said trajectory, including means for displacing said spacing element at a displacement speed lower than said advancement speed, and means for increasing said displacement speed during the displacement of said spacing element in a section of said trajectory commencing at, and in direction away from, at least one of said terminal postions. Advantageously, the displacing means includes a first drive constantly moving at the displacement speed and operatively connected to said spacing element during the displacement thereof in said trajectory. Then the increasing means includes a second drive constantly moving at an increased speed and operatively connected to said spacing element only during the displacement of said spacing element in said section of said trajectory away from said one terminal position, the reciprocating means further including means for deactivating the first drive during the operation of said second drive. Preferably, the deactivating means includes a free-wheeling mechanism in the first drive, between the two drives, or between a common driving arrangement and the first drive.

In a currently preferred embodiment of the apparatus of the present invention the first drive includes a portion of the spacing element which has an elongated slot, a closed-loop driving element driven for travel at the displacement speed, and a pin mounted on the driving element for joint travel therewith and received in the elongated slot of the spacing element to entrain the latter for joint travel. The, the second drive may include an abutment portion of the spacing element, another closed-loop driving element driven for travel at the increased speed, and another pin mounted on the other driving element for joint travel therewith and abutting against the abutment portion of the spacing element when the latter is in the above-mentioned one terminal position thereof to entrain the spacing element for joint travel.

Another concept of the present invention resides in a method of manufacturing a braid of SZ-twisted strands of elongated elements for use in cables, particularly telecommunication cables, which comprises the steps of advancing a plurality of sets of elements at a constant advancement speed along separate and spaced paths; maintaining the elements of each set at a distance from one another at a first location of the respective path; joining the elements of each set into a bundle at a second location of the respective path situated downstream of the respective first location; twisting the respective bundle into a respective strand at a constant twisting speed and in the same twisting direction at a third location of the respective path downstream of the respective second location; uniting the strands into the braid downstream of the third locations; varying the distance of the first locations from the third locations in the same cycle for all of the sets of elements; and performing the cycle of each of the sets in a time-shifted manner relative to the cycles of all other sets. This means that the individual spacing elements are always at different locations from one another with respect to the respective individual paths of the respective sets of elongated elements; however, because of the performance of the same cycle of displacement by each of the spacing elements, a single driving arrangement can simultaneously displace all of the spacing elements, without any need for resorting to the use of transmissions of the like. As a result of the above-discussed sequence of steps, it is achieved that, in the final braid, the regions of each of the strands which have the same twist direction, have the same lengths but are staggered with respect to one another longitudinally of the braid so that, for instance, in a basic braid which is manufactured in a conventional manner from SZ-twisted strands, such as four-wire units or pairs, there is avoided the possibility that two or more parallel regions of the strands which come into existence during the transition between the S-twist could coincide. Rather, such parallel regions are staggered along the braid, whereby the transmission properties of the braid or the cable including such a braid are improved.

According to a currently preferred aspect of the present invention the twisting step includes twisting at least one of the bundles at the twisting speed which is different from the twisting speed of another bundle. Furthermore, it is advantageous when the twisting step includes twisting at least one of the bundles in the twisting direction which is opposite to the twisting direction of another bundle. As a result of this, there can be achieved different lengths of the twisted regions and different directions of twist of such twisted regions so that no periodically repeating asymmetries can develop in the braid consisting of the strands. In the final analysis, this further contributes to an improvement of the transmission properties of the braid and of the cable incorporating such a braid. To further improve such transmission properties, it is further proposed according to an additional advantageous concept of the present invention, to mix the strands prior to the uniting step.

A further advantageous concept of the present invention resides in an apparatus for manufacturing a braid of SZ-twisted strands of elongated elements for use in cables, particularly telecommunication cables, which comprises means for advancing a plurality of sets of the elements at a constant advancement speed along separate and spaced paths; a plurality of spacing elements each for maintaining the elements of one of the sets at a distance from one another; a plurality of inlet nipples each for joining the elements of one of the sets into a bundle downstream of the respective spacing elememt; a plurality of twisting heads each for twisting one of the bundles into a strand at a constant twisting speed and in the same twisting direction downstream of the respective inlet nipple, a plurality of outlet nipples each arranged downstream of the respctive twisting head; means for uniting the strands into the braid downstream of said outlet nipples; means for mounting said spacing elements for displacement along the respctive paths toward and away from the respective twisting head; means for varying the distance of each of said spacing elements from each of the twisting heads in the same cycle; and means for performing the cycles of the spacing elements in a time-shifted manner with respect to each other. Advantageously, the twisting heads are operative for twisting at least two of the bundles at different twisting speeds and/or in opposite twisting directions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
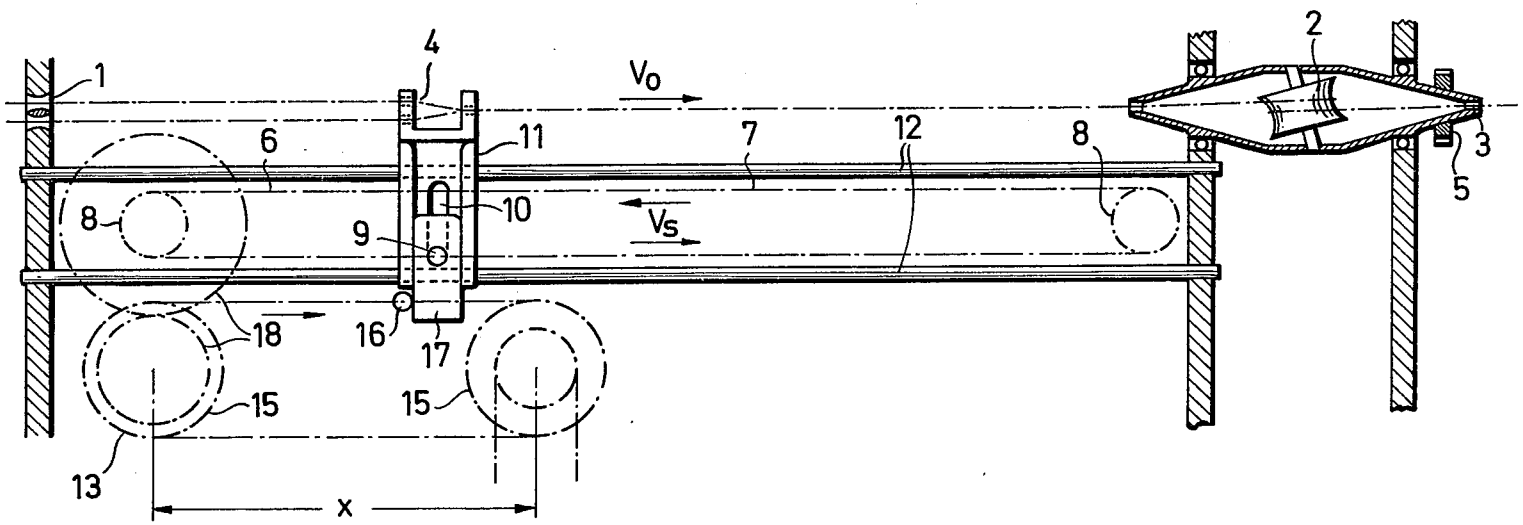
FIG. 1 is a partly sectioned side elevational view of the differential-speed apparatus of the present invention.

Referring now to the drawing in detail, and first to FIG. 1 thereof, it may be seen that the apparatus of the present invention includes an inlet port 1 for each of the individual elongated elements which are advanced at an advancement speed $v_o$ in the rightward direction as illustrated in the drawing. During their advancement, the individual elongated elements are joined into a bundle which enters a twisting head 2 through an inlet nipple and emerges from the twisting head through an outlet nipple 3. A spacing element 4 is arranged between the inlet ports 1 and the twisting head 2 and is displaceable along the guides 12 toward and away from the twisting head 2. As illustrated, the spacing element 4 includes a plurality of orifices for the individual elongated elements, and an outlet orifice for the bundle of the elements. The details of such a spacing element 4 are already well known so that they need no detailed discussion herein. The spacing element 4 is being reciprocated at a predetermined constant displacement speed $v_s$ which is lower than the advancement speed $v_o$ of the elongated elements which are to be SZ-twisted in the apparatus. A gear 5 is mounted on the twisting head 2 and is operative for rotating the twisting head 2 at a constant speed and in the same direction, being driven in rotation by a non-illustrated conventional drive arrangement.

A drive 6 is used for displacing the spacing element 4 at the above-mentioned displacement speed $v_s$. The drive 6 includes a driving chain 7 or a similar closed-loop driving element, the chain 7 being trained about two chain sprockets 8 respectively located at the beginning and the end terminal positions of a trajectory of displacement of the spacing element 4 between the inlet ports 1 and the twisting head 2. A pin 9 or another connecting element is connected to the chain 7 for joint travel therewith. The pin 9 is received in an elongated slot 10 of a displacing portion 11 of the spacing element 4, the portion 11 being located underneath the spacing portion of the spacing element 4. As mentioned above, the spacing element 4 is mounted on the guide rods 12 for displacement longitudinally thereof.

In order to achieve an increase in the displacement speed of the spacing element 4 over a predetermined section x of the trajectory 1 of displacement of the spacing element 4, a further drive 13 is arranged underneath the drive 6, the length of the drive 13 corresponding to the length x of the section of the trajectory. This other drive 13 also includes a chain 14 or a similar closed-loop element, which chain 14 is trained about sprocket wheels 15, one of which is driven by a non-illustrated conventional motor, such as an electromotor. An entraining pin 16 is connected to the chain 14 for joint travel therewith, the entraining 16 cooperating with an abutment portion 17 of the spacing element 4 which is moved in the vertical direction by the pin 9. The two drives 6 and 13 are synchronized with one another, that is, when the spacing element 4 is located at the forward reversing terminal position, that is the terminal position which is more remote from the twisting head 2 than the other reversing terminal position, the entraining pin 16 of the lower drive 13 is located immediately underneath the spacing element 4 so that the entraining pin 16 abuts against the abutment portion 17 of the spacing element 4, and entrains the spacing element 4 for joint travel at a speed which is higher than the original displacement speed $v_s$. Advantageously this increased speed of the lower drive 13 corresponds to the advancement speed $v_o$ at which the elongated elements are being advanced. The length of abutment of the lower drive 13 with the spacing element 4 corresponds to the length x of the section of the trajectory in which the spacing element 4 is to be displaced at the above-mentioned increased speed. The above-discussed entrainment of the spacing element 4 by the lower drive 13 is rendered possible by the fact that a free-wheeling mechanism is interposed between the spacing element 4 and the upper drive 6, such as, for instance, by being incorporated in an upper gear 18 of a transmission between the two drives 6 and 13. At the end of the section x of the lower drive 13, the upper drive 6 takes over the further displacement of the spacing element 4 at the displacement speed $v_s$.

The SZ-twisting apparatus of the present invention is designed for advancement speeds up to 120 m/min. The twisting head 2 can be rotated at up to 5000 revolutions per minute without encountering any difficulties. When the twist of a braid of the strands manufactured in the arrangement of the present invention is to be, for instance, 7000 mm and the length of the SZ-twisted regions of the strands in the braid is to be, for instance, 100 mm, the following operating conditions result:

Advancement speed $v_o$ = 120 m/min, displacement speed of the spacing element $v_s$ = 40 m/min, twisting speeds of the twisting head n = 3430 r.p.m.

Under these circumstances, the trajectory of the spacing element 4 has a length 1 = 1.8 m. This results in S-twist or Z-twist regions of the strand having lengths of 5.4 m.

Figure 2:
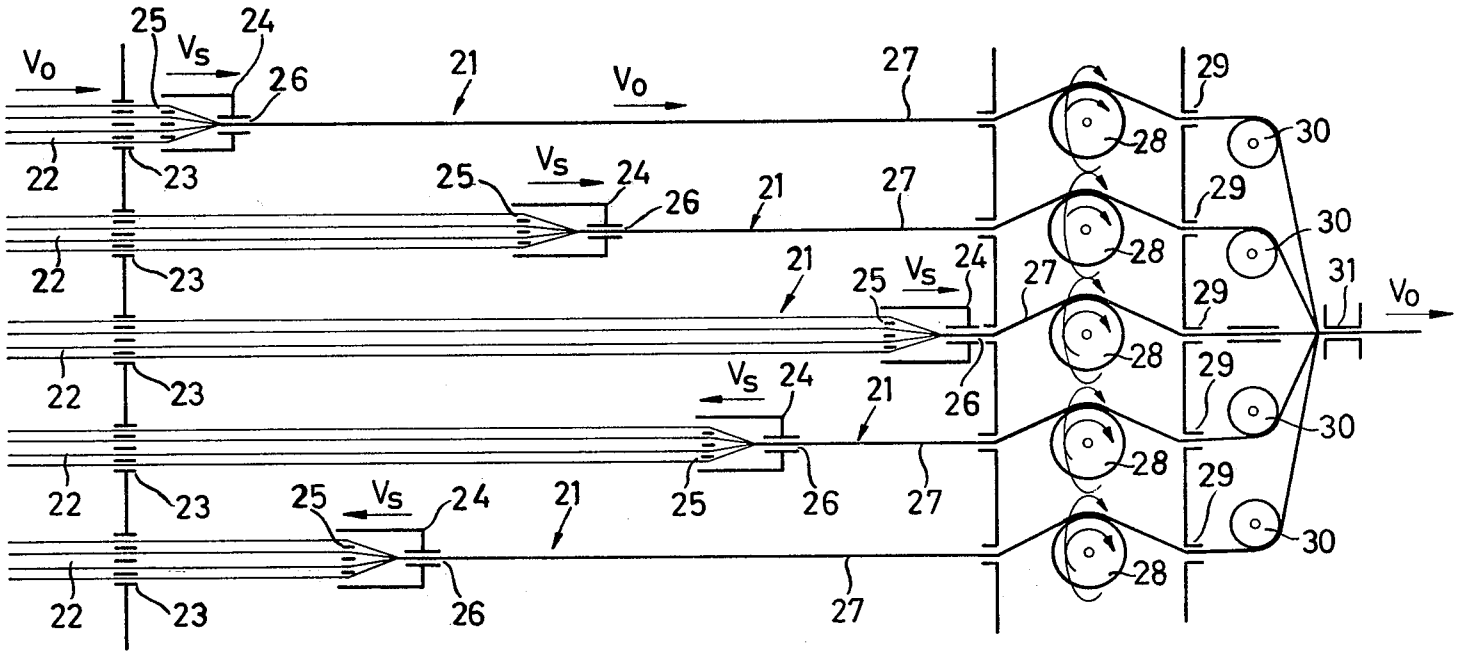
FIG. 2 is a diagrammatic developed view of the differential-location arrangement of the present invention.

Referring now to FIG. 2 it will be seen therein that the arrangement for manufacturing the braid of strands includes five mutually parallel SZ-twisting arrangements designated in toto with the reference numeral 21, each of them operative for SZ-twisting, for instance, four elongated elements 22. The individual elongated elements are withdrawn from non-illustrated conventional drums or similar storage arrangements and passed through inlet ports 23 on their way toward the respective spacing element 24. The spacing elements 24 are conventional and, generally speaking, correspond to the above-mentioned spacing elements 4, each of the spacing elements 24 having, in the illustrated embodiment, a joining orifice 26, at which the individual elongated elements 22 come together. The spacing elements 24 are displaced at a constant speed in the longitudinal direction of the elements 22, either concurrently with or opposite to the advancement direction of the elements 22.

As will appear from FIG. 2, the individual spacing elements 24 are staggered with respect to one another, as a result of which the spacing elements 24, while all going through the same cycle of displacement, are time-shifted in the cycle with respect to one another. The elements 22, after joining one another in a bundle 27 for each of the arrangements 21 are twisted into individual strands by diagrammatically illustrated twisting heads 28 which, in the illustrated embodiment, all rotate in the same direction and at the same speed. Thereafter, the strands pass through the respective outlet nipples 9 arranged at a distance from and downstream of the respective twisting heads 8. Downstream of the outlet nipples 9, the individual twisted strands 27 are trained and diverted about diverting rollers 30, and are united into a braid in a uniting nipple 31. The rotating twisting heads 28 twist the bundles 27 of the elements 22 at the twisting regions located between the spacing elements 24 and the twisting heads 28, on the one hand, and between the twisting heads 28 and the outlet nipples 29, on the other hand, into the SZ-twisted strand 27.

While, in the illustrated embodiment, all of the twisting heads 28 rotate in the same twisting direction, it is also conceivable and proposed by the present invention to rotate the respective twisting heads 28 in different twisting directions. Also, it is contemplated to rotate the individual twisting heads 28 at different twisting speeds.

It will be understood that each of the elements described above, or two or more together, may also find a useful application in other types of constructions, differing from the types described above.

While the invention has been illustrated and described as embodied in a method of and an apparatus for manufacturing SZ-twisted strands or braids of such strands for use in telecommunication cables, it is not intended to be limited to the details shown, since various modifications and structural changes may be made without departing in any way from the spirit of the present invention.

So, for instance, the speeds of displacement of the spacing elements 24 of FIG. 2 could be varied in the same manner as the speed of the spacing element 4 is varied in FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing an SZ-twisted strand of elongated elements for use in cables, particularly telecommunication cables, comprising the steps of advancing the elements at a constant advancement speed along a path; maintaining the elements at a distance from one another at a first location of the path; joining the elements into a bundle at a second location of the path situated downstream of said first location; twisting the bundle into the strand at a constant twisting speed and in the same direction at a third location situated downstream of said second location; and cyclically reciprocating said first location along a portion of the path between two terminal positions, including displacing said first location at a displacement speed lower than said advancement speed, and increasing said displacement speed during the displacement of said first location along a section of the path portion commencing at, and in direction away from, at least one of said terminal positions.

2. A method as defined in claim 1, wherein said increasing step includes raising said displacement speed to said advancement speed.

3. A method as defined in claim 1, wherein said one terminal position is more remote from said second location than the other terminal position.

4. A method as defined in claim 1, wherein said path section has a length x related to the length l of said path portion in accordance with the formula $$x = l \cdot a/a^{1-a}$$

wherein $A = v_s/v_o$, $v_s$ being said displacement speed and $v_o$ said advancement speed.

5. An apparatus for manufacturing an SZ-twisted strand of elongated elements for use in cables, particularly telecommunication cables, comprising means for advancing the elements at a constant advancement speed along a path; a spacing element for maintaining the elements at a distance from one another; an inlet nipple for joining the elements into a bundle downstream of said spacing element; a twisting head for twisting the bundle into the strand at a constant twisting speed and in the same direction downstream of said inlet nipple; an outlet nipple downstream of said twisting head; means for mounting said spacing element for displacement along said path in a trajectory toward and away from said twisting head between two terminal positions; and means for cyclically reciprocating said spacing element in said trajectory, including means for displacing said spacing element at a displacement speed lower than said advancement speed, and means for increasing said displacement speed during the displacement of said spacing element in a section of said trajectory commencing at, and in direction away from, at least one of said terminal positions.

6. An apparatus as defined in claim 5, wherein said increasing means is operative for raising said displacement speed to said advancement speed.

7. An apparatus as defined in claim 5, wherein said increasing means is arranged at and active from that terminal position which is more remote from said inlet nipple than the other terminal position.

8. An apparatus as defined in claim 1, wherein said increasing means is so arranged that said section of said trajectory has a length x that is related to the length l of said trajectory in accordance with the formula $$x = l \cdot a/a^{1-a}$$

wherein $a = v_s/v_o$, $v_s$ being said displacement speed and $v_o$ said advancement speed.

9. An apparatus as defined in claim 5, wherein said displacing means includes a first drive constantly moving at said displacement speed and operatively connected to said spacing element during the displacement thereof in said trajectory; wherein said increasing means includes a second drive constantly moving at an increased speed and operatively connected to said spacing element only during the displacement of said spacing element in said section away from said one terminal position; and wherein said reciprocating means further includes means for deactivating said first drive during the operation of said second drive.

10. An apparatus as defined in claim 9, wherein said deactivating means includes a free-wheeling mechanism in said first drive.

11. An apparatus as defined in claim 9, wherein said first drive includes a portion of said spacing element having an elongated slot, a closed-loop driving element driven for travel at said displacement speed, and a pin mounted on said driving element for joint travel therewith and received in said elongated slot of said spacing element to entrain the latter for joint travel.

12. An apparatus as defined in claim 9, wherein said second drive includes an abutment portion of said spacing element, a closed-loop driving element driven for travel at said increased speed, and a pin mounted on said driving element for joint travel therewith and abutting against said abutment portion of said spacing element when the latter is at said one terminal position thereof to entrain said spacing element for joint travel.

13. An apparatus as defined in claim 9, wherein said reciprocating means includes driving means for synchronously driving said drives; and wherein said deactivating means includes a free-wheeling mechanism interposed between said driving means said first drive.

14. An apparatus as defined in claim 9, wherein said reciprocating means for synchronously driving said drives, including two meshing gears each associated with one of said drives; and wherein said deactivating means includes a free-wheeling mechanism in one of said gears.

15. A method of manufacturing a braid of SZ-twisted strands of elongated elements for use in cables, particularly telecommunication cables, comprising the steps of advancing a plurality of sets of the elements at a constant advancement speed along separate and spaced paths; maintaining the elements of each set at a distance from one another at a first location of the respective path; joining the elements of each set into a bundle at a second location of the respective path situated downstream of the respective first location; twisting the respective bundle into a respective strand at a constant twisting speed and in the same twisting direction at a third location of the respective path downstream of the respective second location; uniting the strands into the braid downstream of said third locations; varying the distance of said first locations from said third locations in the same cycle for all of said sets of elements; and performing the cycle for each of said sets in a time-shifted manner relative to the cycles of all other sets.

16. A method as defined in claim 15, wherein said twisting step includes twisting at least one of said bundles at said twisting speed which is different from said twisting speed of another bundle.

17. A method as defined in claim 15, wherein said twisting step includes twisting at least one of said bundles in said twisting direction which is opposite to said twisting direction of another bundle.

18. A method as defined in claim 15; and further comprising the step of mixing said strands prior to said uniting step.

19. An apparatus for manufacturing a braid of SZ-twisted strands of elongated elements for use in cables, particularly telecommunication cables, comprising means for advancing a plurality of sets of the elements at a constant advancement speed along separate and spaced paths; a plurality of spacing elements each for maintaining the elements of one of said sets at a distance from one another; a plurality of inlet nipples each for joining the elements of one of said sets into a bundle downstream of the respective spacing element; a plurality of twisting heads each for twisting one of the bundles into a strand at a constant twisting speed and in the same twisting direction downstream of the respective inlet nipple; a plurality of outlet nipples each arranged downstream of the respective twisting head; means for uniting the strands into the braid downstream of said outlet nipples; means for mounting said spacing elements for displacement along the respective paths toward and away from the respective twisting head; means for varying the distance of each of said spacing elements from each of said twisting heads in the same cycle; and means for performing the cycles of said spacing element in a time-shifted manner with respect to each other.

20. An apparatus as defined in claim 19, wherein said twisting heads are operative for twisting at least two of said bundles at different speeds.

21. An apparatus as defined in claim 19, wherein said twisting heads are operative for twisting at least two of said bundles in opposite twisting directions.

22. An apparatus as defined in claim 19, and further comprising means for mixing said strands interposed between said outlet nipples and said uniting means.

* * * * *